US005364567A

United States Patent [19]

Chang et al.

[11] Patent Number: 5,364,567

[45] Date of Patent: Nov. 15, 1994

[54] SOLUTION FOR PREPARING A CONDUCTIVE FILM FOR A FLAT BROWN TUBE

[75] Inventors: Dong-Sik Chang, Gwachon; Su-Min Chung, Suwon, both of Rep. of Korea

[73] Assignee: Samsung Display Devices Co., Ltd., Hwasung, Rep. of Korea

[21] Appl. No.: 51,374

[22] Filed: Apr. 23, 1993

[30] Foreign Application Priority Data

Apr. 24, 1992 [KR] Rep. of Korea ..... 92-6998

[51] Int. Cl.[5] ..... H01B 1/00; H01B 1/06; H01B 1/08; H01B 1/10

[52] U.S. Cl. ..... 252/518; 106/286.1; 106/287.1; 106/287.11

[58] Field of Search ..... 252/518; 106/286.1, 106/287.1, 287.11

[56] References Cited

U.S. PATENT DOCUMENTS 4,702,773 10/1987 Ashlock et al. ..... 106/287.12

*Primary Examiner*—Paul Lieberman
*Assistant Examiner*—M. Kopel
*Attorney, Agent, or Firm*—Cushman Darby & Cushman

[57] ABSTRACT

A fine conductive film having improved transparence, good conductivity and low-cost characteristics for use on a flat Braun tube to achieve an improved operational efficiency and cost reduction effect, is made by application at room temperature of on constituent selected from the group consisting of indium chloride, indium nitride and indium sulfide, possibly supplemented by tin chloride, dissolved in water and having added to the resulting solution an organo amino silane ester, to thereby form an indium and/or tin hydrate which is then cured by gradually raising the temperature to over 390° C. and up to 450° C.

9 Claims, 1 Drawing Sheet

SOLUTION FOR PREPARING A CONDUCTIVE FILM FOR A FLAT BROWN TUBE

BACKGROUND OF THE INVENTION

1. Field of the Invention

The present invention relates to a conductive film for a flat Braun tube and a solution for preparing such a film, and more particularly to solution for preparing a conductive film which can eliminate electrons remaining on a fluorescent screen and secondary electrons when object images are displayed on a flat Braun tube.

2. Description of the Prior Art

Generally, a flat Braun tube has a construction as illustrated in FIG. 1, wherein electrons generated from an electron gun 1 are concentrated and accelerated at a grid, deflection yoke 2 and the like to thereby be emitted directly onto a fluorescent screen 3.

At this moment, visible rays emitted from the fluorescent screen 3 are reflected onto an aluminum film interposed between the fluorescent screen 3 and a screen panel 4 to thereby form pictorial images.

Some of the electrons irradiated to the fluorescent screen 3 stay at the screen 3, and when those electrons collides with the screen 3, secondary electrons are generated out of the collision to thereby make the screen 3 unable to form subsequent images.

Accordingly, as a means of eliminating the residual electrons and secondary electrons, a conductive film should be installed between the screen 3 and an inner graphite element formed on an inner panel 6.

As the conductive film, a graphite film, an indium oxide (In2,O3) thin film, an indium oxide-tin oxide (ITO) thin film, a tin oxide thin film, a tin oxide-antimonial oxide thin film (SnO2-Sb2O3) and the like are utilized.

However, in case of using graphite film for the conductive layer, there is a drawback of poor appearance, resulting in general usage of the indium oxide-tin oxide thin film (ITO), tin oxide-antimonial oxide thin film and the like.

As conventional methods for forming the conductive layer, a sputtering method, E-Beam method and the like have been utilized. However, these methods and materials thereof cost a great deal of money, making it difficult to apply the same to a flat Braun tube.

For example, a spray method utilizing a thermal decomposition technique described on pages 618–622, the 7th issue of volume 47 of "*Applied Physics*" published by the electronic development department of Shibaura laboratory situated in 3-9-14, Shibaura, Minatoku, Tokyo 108, Japan, has been used to solve the aforementioned drawbacks. However that method calls for heating of the material to be used for formation of transparent conductive film to over 400° C. and spraying of a InCl3/SnCl4 solution for a sufficient conductivity characteristics.

If the aforementioned method is applied to a flat Braun tube, there arise various problems ranging from degradation of fluorescent material, to manufacturing difficulty, to deterioration in operational efficiency, and the like.

Accordingly, it is an object of the present invention to provide a solution for manufacturing conductive film for a low-priced flat Braun tube, which can improve the conductivity and operational efficiency of the tube.

SUMMARY OF THE INVENTION

In accordance with one aspect of the present invention, there is provided a solution for making a conductive film for a flat Braun tube wherein one constituent selected from the group consisting of indium chloride, indium nitride and indium sulfide, possibly supplemented by tin chloride, is dissolved in water to which is thereafter added organo-amino-silane-ester, so that solution pH can be maintained within the range of 1.5–4.

In making the conductive film, one constituent selected from the group consisting of indium chloride, indium nitride and indium sulfide, possibly supplemented by tin chloride, is dissolved in water to form a solution to thereafter have added thereto an organo amino silane ester, so that solution pH can be maintained within the range 1.5–4. The solution having a pH of 1.5–4 is uniformly applied on a Braun tube screen panel and thereafter drying for approximately 20 minutes to 50° C., so that a conductive layer is formed.

Conventionally, in order to form a transparent conductive film by using indium chloride, an aqueous solution of indium chloride or alcohol solution thereof is sprayed on a material that has been heated to 400°–450° C.

$$InCl_3 \xrightarrow[400\text{–}450^\circ\ C.]{} In_2O_3$$

If the sprayed coating is slowly heated after it has been sprayed into place, the conductive characteristics can not be obtained. Therefore, in order to form a transparent conductive film by the former method, a separate apparatus that enables the spray to be performed under a very high temperature is necessitated.

BRIEF DESCRIPTION OF THE DRAWINGS

For a fuller understanding of the nature and objects of the invention, reference should be made to the following detailed description taken in conjunction with the accompanying drawings, in which.

DETAILED DESCRIPTION OF THE INVENTION

Figure 1:
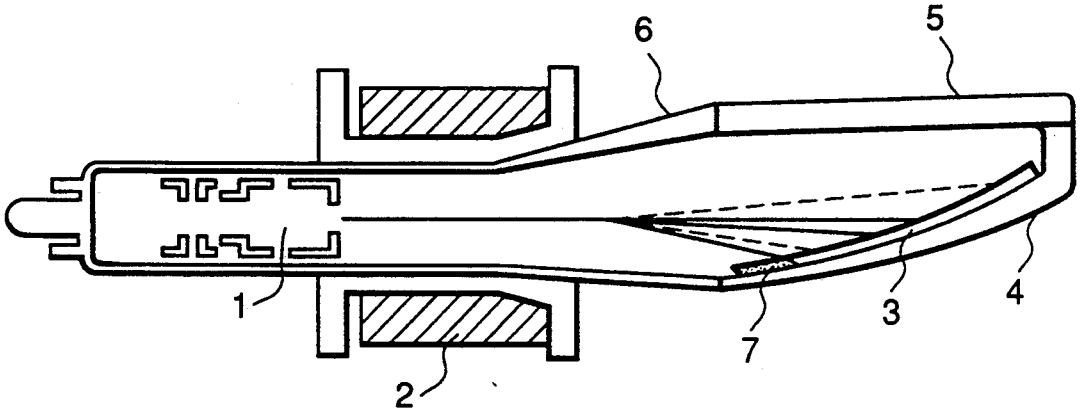
Fig. 1 (PRIOR ART)
FIG. 1 is a longitudinal sectional view of a conventional flat Braun tube.
Figure 2:
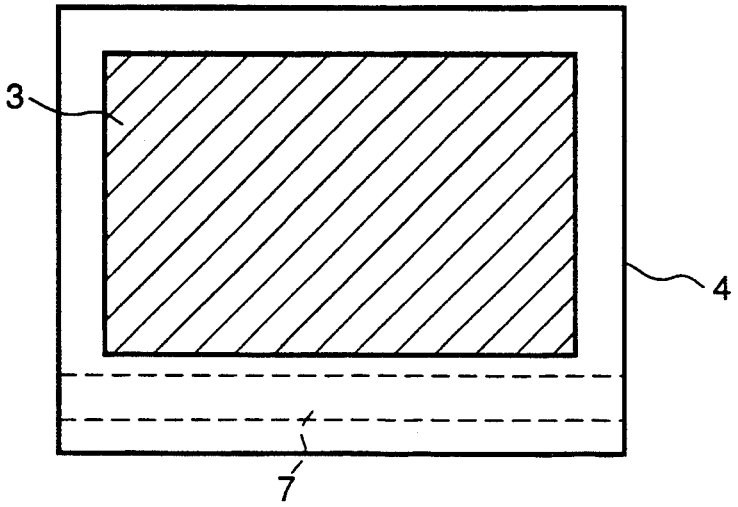
Fig. 2 (PRIOR ART)
FIG. 2 is a schematic fragmentary elevational view showing a construction of a screen panel of the conventional Braun tube of FIG. 1.

In an aqueous solution that will form a transparent electrically conductive film is made, and then the present invention, the indium chloride is spread on an appropriate surface between the screen and inner graphite element on an inner panel of a Braun tube, while at the room temperature. Then, the temperature is are slowly increased. In order to obtain fine conductive characteristics, the aqueous solution contains one constituent selected from the group consisting of indium chloride, indium nitride and indium sulfide, possibly supplemented by tin chloride, and an organo amino silane ester.

Because the amino acid of the organo amino silane ester is a strong alkali, it produces conductive oxide particles by reacting with the one constituent selected from the group consisting of indium chloride, indium nitride and indium sulfide, possibly supplemented by tin chloride, and as the amino acid itself is a surface active agent, and prevents a sedimentation of the particles to thereby form an even conductive oxide film in the course of the spraying and heating.

Furthermore, the organo amino silane ester becomes silicon dioxide $SiO_2$ to thereby form a transparent film, so that a transparence can be improved.

The film-forming characteristic, conductivity and transparence of the conductive film are determined by the added quantity of the organo amino silane ester in the solution from which the conductive film is made.

The concentration of the one constituent selected from the group consisting of indium chloride, indium nitride and indium sulfide, possibly supplemented by tin chloride, in the said solution is 2–30% and the added quantity of the organo amino silane ester is sufficient to provide a pH 1.5–4 when added to the solution.

If the concentration of the one constituent selected from the group consisting of indium chloride, indium nitride and indium sulfide, possibly supplemented by tin chloride, is below 2%, the conductive characteristic can be regarded as bad, and if above 30%, the particle size of generated conductive oxide becomes big, causing a sedimentation, so that an even film can hardly be obtained.

The results obtained by making the solution of the present invention and using it to provide the conductive film of good conductivity and transparence for a flat Braun tube are shown in the following examples.

EXAMPLE 1

Two grams of indium chloride are dissolved in a mixture of 90 cc of pure water and 10 cc of methanol to provide a solution, into which 0.5 cc of N-Beta(Amino-ethyle)-Gamma-Amino-Propyl Tri Methoxy Silane is slowly drip-fed. The resulting solution is thereafter agitated for an hour, and then is evenly applied to the screen panel 4 of the flat Braun tube, using a roller or the like, and thereafter dried at 50° C. for approximately 20 minutes.

After the conductive film thus constructed is formed, a flint glass is applied to the screen panel 4, front panel 5 and funnel 6, which are put into a furnace, so that the same can be cured for approximately 30 minutes at a temperature of 450° C.

The electrical resistant value of the conductive film layered on the screen panel 4 in the above-described process used in this Example is 60KΩ/cm. However, if an exhaust procedure is performed on the Braun tube after the insertion of the electron gun, the resistant value becomes approximately 20KΩ/cm, which is adequate for electron emission.

EXAMPLE 2

Ten grams of indium chloride and 1.5 grams of tin chloride are sufficiently dissolved in a mixture of 80 cc of pure water and 20 cc of ethanol, into which 3 cc of gamma-amino-propyl-triepoxy-silane is slowly drip-fed. The resulting solution is thereafter agitated for approximately one hour.

The resulting solution is applied to the flat Braun tube, and heated, as explained in EXAMPLE 1 to thereby obtain a conductive film having a resistant value of 5KΩ/cm.

EXAMPLE 3

Six grams of indium sulfide and 2 grams of tin chloride are sufficiently dissolved in a mixture of 80 cc of pure water and 20 cc of ethanol, into which 3 cc of gamma-amino-propyl-trihychloroxy silane are slowly drip fed. The solution is thereafter agitated for approximately one hour. Then, 3 drops of Triton X-100, a surface active agent manufactured by Rohm and Haas, is added to the agitated solution and thereafter further mixed for approximately 30 minutes.

The resulting solution is applied to the flat Braun tube, and heated, as explained in EXAMPLE 2 to thereby obtain a conductive film having a resistant value of 15k Ω/cm.

As seen from the foregoing, the present invention has been presented to provide a solution for making a conductive film having a fine conductivity applied to a flat Braun tube. The results are an improved operational efficiency and a cost-reduction effect.

What is claimed is:

1. A solution which can be applied to a surface of a Braun tube, and dried, to produce a transparent electrically conductive layer having a surface resistance of from 5kΩ/cm to about 20kΩ/cm, said solution comprising:

an aqueous solution containing one constituent selected from the group consisting of indium chloride, indium nitride and indium sulfide, and a sufficient quantity of an organo amine silane to adjust the pH of said aqueous solution to be within the range of 1.5 to 4.

2. The solution of claim 1, wherein:

said aqueous solution includes as a solvent a mixture of pure water and an alcohol selected from the group consisting of methanol and ethanol.

3. The solution of claim 2, wherein:

said pure water and alcohol are present in a proportion of 80:20 by volume.

4. The solution of claim 1, wherein:

said organo amino silane ester has a general formula selected from the group consisting of $NH_2(CH_2)mSi(OR)_3$, and $NH_2(CH_2)mNH(CH_2)nSi(OR)_3$, in which:

m is an integer in the range 1–5, n is an integer in the range of 1–5, and

R is selected from the group consisting of H, $CH_3$, $C_2H_5$, $C_3H_7$ and $C_4H_9$.

5. The solution of claim 1, wherein:

said constituent is indium chloride.

6. The solution of claim 5, wherein:

concentration of said indium chloride in said aqueous solution is about from 2% to about 30% by weight.

7. The solution of claim 1, wherein:

said aqueous solution contains more than 30% pure water, by volume.

8. The solution of claim 1, wherein:

said aqueous solution further contains a surface active agent.

9. The solution of claim 1, wherein:

said constituent is supplemented by tin chloride.

* * * * *